United States Patent [19]

Parry

[11] 4,449,675

[45] May 22, 1984

[54] FABRIC REWIND SYSTEM

[76] Inventor: John C. Parry, 6729 Brookmont Dr., Baltimore, Md. 21207

[21] Appl. No.: 306,944

[22] Filed: Sep. 30, 1981

[51] Int. Cl.[3] ..... B65H 35/02; B65H 17/08

[52] U.S. Cl. ..... 242/56.2; 242/65; 242/67.3 R

[58] Field of Search ..... 242/56.2, 65, 56.4, 242/55, 56.5, 56.6, 56.7, 56.9, 67.3, 75.2

[56] References Cited

U.S. PATENT DOCUMENTS

| | | | |
|---|---|---|---|
| 1,829,727 | 11/1931 | Barrett | 242/67.3 R |
| 2,983,459 | 5/1961 | Gray et al. | 242/67.3 R |
| 3,157,371 | 11/1964 | Billingsley | 242/56.2 |
| 3,412,636 | 11/1968 | Seiff | 242/56.2 X |
| 4,095,754 | 6/1978 | Campo | 242/68.3 X |

*Primary Examiner*—Stuart S. Levy
*Assistant Examiner*—Lloyd D. Doigan
*Attorney, Agent, or Firm*—Walter G. Finch

[57] ABSTRACT

The invention is an improved system for rewinding fabric, particularly such fabrics which are more or less impervious and tend to entrap air between successive layers of the fabric being wrapped upon a core means as the rewinding proceeds. The system may be operated in a horizontal rolling mode or in a vertical rolling mode. When operating in the horizontal mode the system utilizes the weight of the supply roll to directly maintain more or less air-free layers, alternatively a minimum mechanical pressure is maintained at the supply roll in the horizontal mode as the weight of the supply roll diminishes near the end of the supply. When operating in the vertical mode, the pressure means is reversed, utilizing a constant mechanical pressure of the roll, or rolls, being wrapped against the supply roll as the rewinding proceeds. This direct pressure system to maintain more or less air-free layers eliminates the tedious and time-consuming threading of the fabric over and under a complicated system of a plurality of idler rolls, drive roll, rider roll, and a core.

8 Claims, 6 Drawing Figures

FABRIC REWIND SYSTEM

BACKGROUND AND SUMMARY OF THE INVENTION

The invention relates to fabric winding equipment and systems, and particularly to fabric rewinding equipment and systems. Specifically, the invention relates to fabric rewinding systems that have a tendency to entrap air between successive layers of the fabric being wrapped upon a core means as the rewinding proceeds.

The entrapped air enlarges the size of the roll, requiring larger packing or packaging means, and ultimately greater bulk in storage. The entrapped air makes the roll spongy which hinders some types of applications and makes the subsequent use difficult. The entrapped air is particularly undesirable in rolls of fabric such a stretch-type film or plastics types of film. The present invention eliminates these problems.

In the prior art, fabric being rewound from a supply roll is tediously threaded through and around a maze of a plurality of idler rolls, drive roll, rider roll, and a core. This is a time-consuming process of threading the fabric over and under the complicated system of the rolls. The present invention eliminates these problems.

In the present invention there are essentially only two rolls, the supply roll and the core on which the fabric is being rewound. There isn't any complicated and time-consuming threading of the fabric through a maze of roll means as in the prior art. The set-up time is rapid and simple.

The system of the present invention may be operated in a horizontal mode or in a vertical mode. In the horizontal mode the horizontal supply roll is arranged so as to rise a short distance from the core position while the core is set into place, thereafter, as the core begins to rewind fabric from the supply roll the supply roll is lowered and rests on the rewinding roll as it turns. The system may be arranged for either the supply roll or the rewind roll to be powered.

The system as shown in the drawings provides for the core roll being powered and thus pulling, withdrawing, or in effect peeling, the fabric from the supply roll. The weight of the supply roll rolling upon the roll being wound upon the core, squeezes the air from the continuous spiral-like layer being played on to the core. A very tight and compact roll results without the mass of air between the spiral like layers.

One example is to rewind a roll of 6000 feet in length on to four smaller rolls of 1500 feet each in length. As a measuring device rolling on the surface of the fabric being peeled off stops the machine at each 1500 feet, the operator removes the rewound core and inserts another blank core. It is a very quick operation to draw the fabric around the new core means in a first wrap and restart the rewind process. It is to be understood that any length of a supply of fabric can be rerolled upon a rewind roll.

It is to be noted that the process is also applicable to supply rolls that are being slit and the slit units wrapped upon separate core means.

One problem arises as the horizontal supply roll diminishes, the weight of the supply roll reduces as the roll diminishes so that as the last portion is peeled off for the last rewinding roll, the weight is such that the rewound roll may not be as tight, with some chance of some air entrapment between some of the spiral-like layers. To overcome this, a pre-load pressure means is added to the shaft means of the supply roll to maintain a minimum load upon the rewinding roll, even though the static load of the supply roll is steadily diminishing.

In the vertical mode the vertical supply roll exerts no pressure upon the roll or rolls being rewound from the supply. It is to be noted when a large supply roll is to be slit into several shorter rolls, the vertical mode has advantages, in that the plurality of shorter rolls can be spaced around the periphery of the suppy roll. This peripheral spacing makes it convenient for servicing each roll being rewound from the supply roll.

In the vertical mode, as noted hereinbefore, the supply roll exerts no pressure upon the roll or rolls to be rewound to keep the air squeezed out from between the spiral-like layers. Instead, in the vertical mode, each of the rewind rolls is pre-loaded to maintain a constant contact pressure with the supply roll so that the air is constantly squeezed out from under the layer of fabric being wound at the moment upon each of the rewind rolls.

The fabric rewind system of the present invention is applicable to a wide range of fabrics, including those of cloth, paper products, plastics materials, and particularly those such as plastics stretch film. The system is particularly useful for rewinding impervious type fabrics under which air may be trapped. It is to be noted that the terms "fabric" and "web" may be used interchangibly.

It is, therefore, an object of the invention to provide a fabric rewind system capable of rewinding all types of fabric.

It is also an object of the invention to provide a fabric rewind system that will rewind plastics and other types of impervious fabrics, including such fabrics as plastics stretch film.

It is a further object of the invention to provide a fabric rewind system that will operate in a horizontal mode and in a vertical mode.

It is another object of the invention to provide a fabric rewind system that continually squeezes any entrapped air from between succeeding spiral-like layers of fabric being rewound.

It is still another object of the invention to provide a fabric rewind system that eliminates the need for one or a plurality of idler rolls between the supply roll and the rewind roll.

It is yet another object of the invention to provide a fabric rewind system that rewinds directly from the supply roll to the rewind roll.

It is yet still another object of the invention to provide a fabric rewind system that utilizes the weight of the supply roll to squeeze entrapped air continually from between succeeding spiral-like layers of fabric being rewound in a horizontal mode.

It is also another object of the invention to provide a fabric rewind system that uses a rewind pressure means to squeeze entrapped air continually from between succeeding spiral-like layers of fabric being rewound in a vertical mode.

Further objects and advantages of the invention will become more apparent in the light of the following description of the preferred embodiments.

DESCRIPTION OF THE PREFERRED EMBODIMENTS

Figure 1:
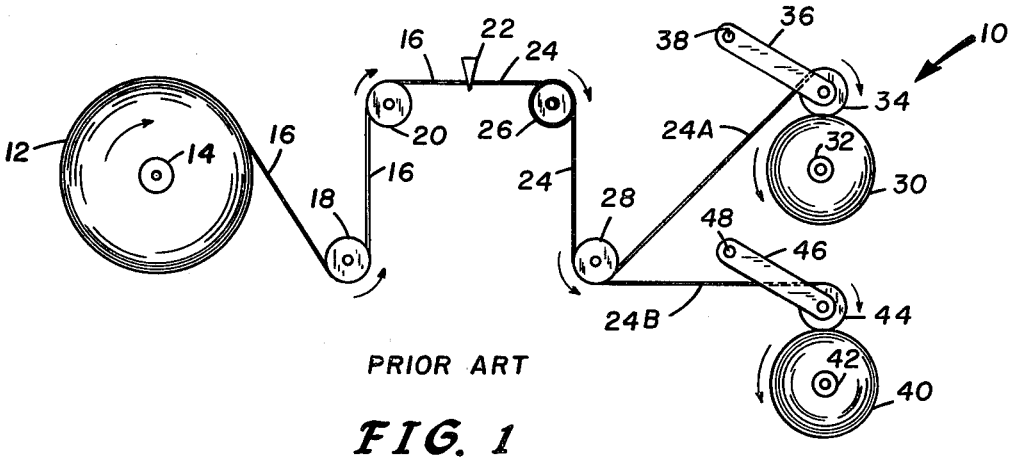
PRIOR ART FIG. 1
FIG. 1 is a schematic end view of a typical fabric rewind system of the prior art.
Figure 2:
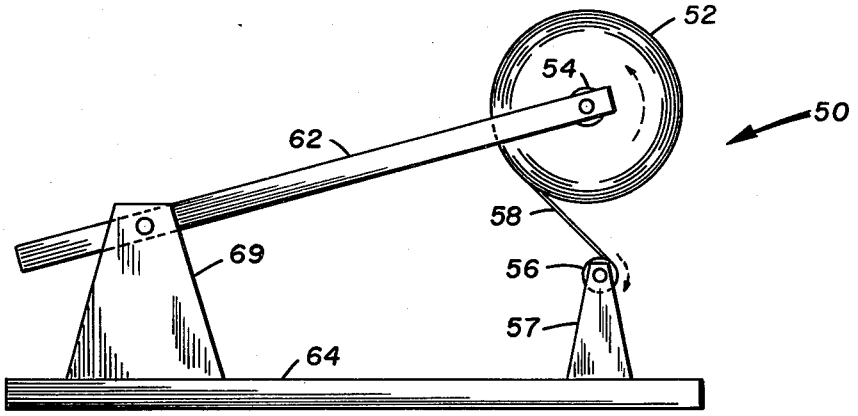
FIG. 2 is a schematic end view of a first embodiment of an improved fabric rewind system in stopped position for affixing a fabric to a core, shown in the horizontal mode.
Figure 3:
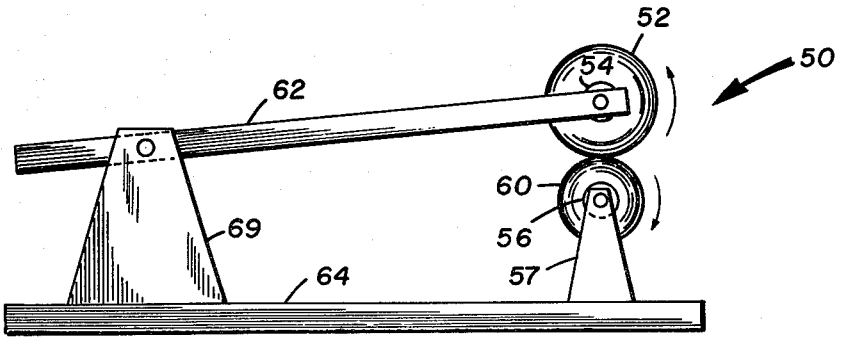
FIG. 3 is a schematic end view of FIG. 2 in operating position.
Figure 4:
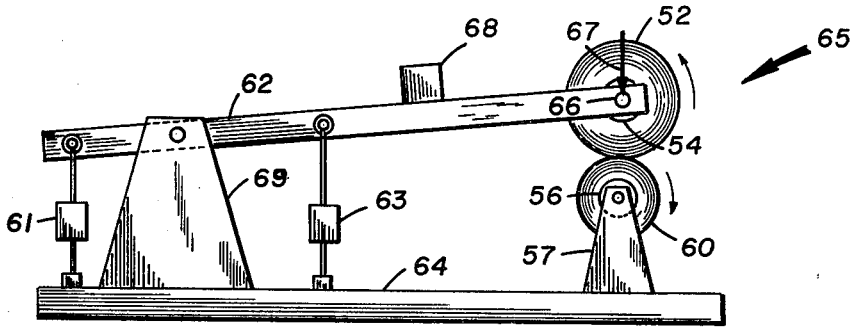
FIG. 4 is a schematic end view of FIG. 3 with pressure means applied to fabric supply roll shaft as a second embodiment of an improved fabric rewind system.
Figure 5:
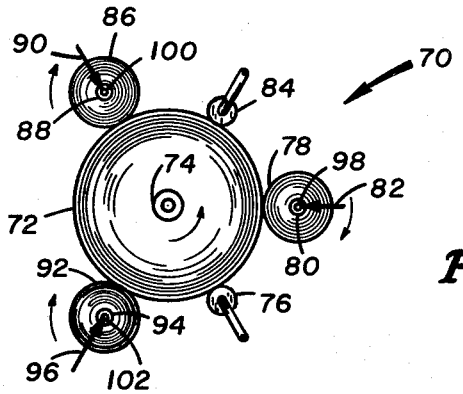
FIG. 5 is a schematic top view of a third embodiment of an improved fabric rewind system in operating position, shown in the vertical mode.
Figure 6:
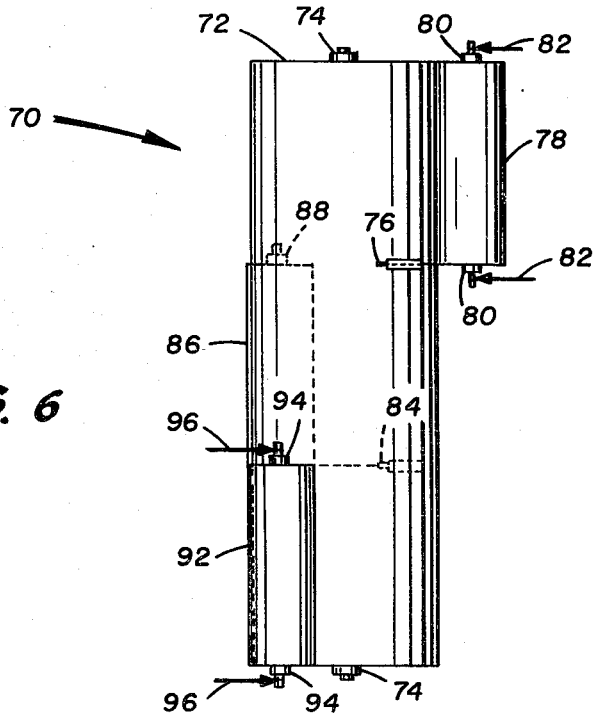
FIG. 6 is a schematic side view of FIG. 5.

Referring to the drawings: a typical fabric rewind system of the prior art is shown at 10 in FIG. 1; a first embodiment of the present invention of an improved fabric rewind system is shown at 50 in FIGS. 2 and 3; a second embodiment of the present invention is shown at 65 in FIG. 4; and a third embodiment of the present invention is shown at 70 in FIGS. 5 and 6.

Referring again to FIG. 1 to discuss the typical fabric rewind system of the prior art 10, the complexity of the maze of rolls and the threading of the fabric through them is readily apparent.

The fabric of the supply roll 12 of fabric on core means 14 is threaded through the complicated plurality of rolls: first by leading the fabric 16 under a first idler roll 18; then over a second idler roll 20; then past a slitter means 22, if the fabric is to be slit into two or more portions, thereafter the fabric 16 would move forward as a plurality of fabric sheets 24; next the plurality of fabric sheets 24 pass over a rubberized or similar type drive roll 26; then under a third idler roll 28, at which point the several sheets 24 (two are illustrated) would be directed to separate rewinding rolls as described hereinafter; fabric sheet 24A passes over a rider roll 34, the rider roll 34 revolving on a carrier arm means 36 which pivots about a fixed point 38; the fabric sheet 24A is then rewound upon a core means 32 to form the first rewound roll 30; the fabric sheet 24B follows a movement similar to fabric sheet 24A, first passing over a rider roll 44, the rider roll 44 revolving on a carrier arm means 46 which pivots about a fixed point 48, the fabric sheet 24B is then rewound upon a core means 42 to form a second rewound roll 40.

The direction of the turning of the various rolls (supply, idler, drive, rider, and rewind) in FIG. 1 is indicated by the arrows at each roll. It is to be noted that the fabric rewind systems of the prior art are essentially of a horizontal mode.

It is to be noted that if a supply roll 12 were merely being rewound as a plurality of smaller capacity rolls, without slitting, the aforementioned references to fabric sheet 24B and the associated rolls leading to the rewound roll 40 would be eliminated.

The rider roll 34, and the rider roll 44, serve to squeeze the air out from between the successive layers of fabric that are laid in a spiral-like fashion to form the rewound rolls of fabric 30 and 40 respectively.

The complicated maze of rolls and the need for tedious threading of the fabric around the plurality of rolls in the prior art is obvious. The present invention eliminates these problems.

Turning now to FIGS. 2 and 3, the first embodiment of an improved fabric rewind system 50 is illustrated. In FIG. 2 the supply roll 52 of fabric on a core means 54 is at a standstill and is shown raised from contact with core means 56, upon which fabric 58 is to be rewound into smaller rolls. The direction that the supply roll 52 and the rewind roll or core means 56 turn may be reversed but only one direction is shown by dashline arrows in this illustration. The raised position of the supply roll 52 permits a new core means 56 to be inserted in the rewind machine, easily, and provides space to start the next wrap of fabric 58 around the core means 56.

In FIG. 3 the aforementioned supply roll 52 is shown in operation and rewinding the fabric upon core means 56 to form the rewind roll 60 of the fabric. The direction of turning of the rolls is shown by the arrows. The direction of turning is shown in all views for all embodiments by similar directional arrows. It is to be noted that these directions of turning could be reversed.

The supply roll 52 rides directly upon the fabric as it peels off of supply roll 52 and rewinds directly upon the rewinding roll 60 on core 56. This action of the supply roll 52 riding directly upon the fabric at the interface, where it is being rewound to form the rewound roll 60, squeezes the air out from between the succeeding layers of fabric to form a firm and tight roll without entrapped air between the successive layers of the spiral-like winding.

Thus, the first embodiment of the improved fabric rewind system is a distinct improvement over the prior art. There isn't any plurality of a complicated maze of rolls and no threading of the fabric is necessary. A tremendous amount of time is saved in set up and in starting the next succeeding roll of fabric. As described, the first embodiment of an improved fabric rewind system 50 is in a horizontal mode.

Depending upon the size of roll being rewound and the dead weight of the mandrel or shaft means in the core means 54 and the core means 54 itself, the last rewound roll 60 from the supply roll 52 may be somewhat loose in comparison to the tight and compact prior rewound rolls 60 that were first taken from the supply roll 52. Although this slightly loose last roll is still satisfactory for use, the slightly larger diameter may interfere with the ease of packing. To cause all rewound rolls 60 to be of the same tight and compact consistency and of substantially the same size, a second embodiment of the improved fabric rewind means is provided.

It is to be noted that the core means 56 is carried and supported by a combined powered head stock means and a dead tail stock means 57. The core means 56 is directly under the core means 54 in a vertical plane, so that the supply roll 52 rests directly on the rewind roll 60 during operation.

It is to be noted that the desirability of tight and compact rolls of rewound fabric are desirable to reduce bulk for packing and storage. In addition, the tight and compact rolls of rewound fabric without the entrapped air between the succeeding spiral-like layers of fabric are most desirable to assure an ease of use. The fabric without entrapped air will peel off easier, better, and in a more firm and positive manner for the succeeding use. It is most desirable to produce these tight and compact rolls without the time consuming and tedious task of doing the rewinding by the typical prior art method and system of a maze of a plurality of rolls.

It is to be noted and understood that the power may be applied to the supply roll 52 core means 54 instead of to the core means 56. Such a variation is within the scope and intent of this invention.

Turning now to FIG. 4 to discuss the second embodiment of an improved fabric rewind system 65 of this invention, it is to be noted that the arrangement is essentially the same as for the first embodiment of an improved fabric rewind system 50. The second embodiment of an improved fabric rewind system 65 is also in a horizontal mode like the first embodiment.

The difference between the first and second embodiment of an improved fabric rewind system 50 and 65, respectively, is that in the second embodiment a minimum downward constant pressure is maintained on the journal ends of the mandrel or shaft means 66 through the core means 54 of the supply roll 52 of fabric to be rewound. This is achieved by a downward pressure structural means 67 bearing upon the journal ends of the mandrel or shaft means 66 through the core means 54 of the supply roll 52 of fabric that is to be rewound.

It is to be noted that this downward pressure structural means 67 may be achieved by several methods: by a direct pre-loaded means 68 bearing down directly upon the journal ends of the said mandrel or shaft means 66; by an upward pressure 61 upon a rear cantilever end of the suspension means 62 for the supply roll, thus forcing the supply roll downward; or by downward pull means 63 on a forward cantilever end of the suspension means 62 for the supply roll. Further, the downward pressure means 68 could be solid, granular, liquid, or any such means to provide instant increase as the supply roll diminishes. The means 61 and 63 could be air, springs, hydraulic, rubber, or any such means to provide instant increase as the supply roll diminishes.

The minimum downward constant pressure that is to be maintained is that amount that is required to overcome the diminishing weight of the supply roll 52 as it nears the end of the fabric upon it. It is desirable that the downward pressure come into action, or be applied as a constant, so that the last roll 60 will not be of a loose type of wrap, but will maintain the tight and compact wrap of the initial rewound rolls 60.

The downward pressure structural means 67 may be of an adjustable pre-loaded type so that by experiment the amount of downward pressure required on the journal ends of the mandrel or shaft means 66 can be refined to the amount needed but would not be excessive. The variation of the aforementioned downward pressure means should be noted.

The combination of the suspension means 62, the head and tail stock means 57, along with a base 64 and support 69 form a frame means for the system.

Turning now to the third embodiment of a fabric rewind system 70 shown in FIGS. 5 and 6, it is to be noted that the third embodiment is operated in a vertical mode. Essentially the horizontal and vertical modes are alike in operation and structure, and produce substantially the same results.

The vertical mode provides a simpler means for loading the core means and controlling the pressure that expels the entrapped air from between succeeding spiral-like layers of fabric. The vertical mode maintains all rewinding core means, and the rewinding rolls upon them, in the same relative location to the surface of the supply roll of fabric being rewound, when a slitting operation is involved, or for a single rewind roll when a slitting operation is not involved.

FIG. 5 is a top view of the vertical mode and FIG. 6 is a side view of FIG. 5. In the third embodiment of a fabric rewind system 70, a supply roll 72 of fabric to be rewound, or to be slit and rewound, is on a core means 74 and it revolves about the center of the core means 74 in the direction of the arrow in FIG. 5.

Three rewinding rolls 78, 86, and 92 are shown equally spaced around the supply roll 72. It is to be understood that any plurality of rewinding rolls about the vertical supply roll 72 is within the scope and intent of this invention. In a simple rewind operation, without slitting, only one rewinding roll would be involved. It is also to be noted that the direction of rotation could be reversed and still be within the intent and scope of this invention.

The rewinding rolls 78, 86, and 92 are being rewound on core means 80, 88, and 94 respectively. In order to maintain an equal and constant pressure between the rewinding rolls 78, 86, and 92 and the supply roll 72, so that entrapped air is squeezed out from between the succeeding spiral-like layers of fabric being rewound, an inward pressure structure means 82, 90, and 96 is imposed upon the journal ends of the combined head and tail stock means 98, 100, and 102, respectively, that are inserted into the core means 80, 88, and 94, respectively. The application of the inward pressure through inward pressure structure means 82, 90, and 96 is comparable and similar to the downward pressure structural means 67 in action and in configuration, including the frame means.

Thus, the same pressure relationship exists in the third embodiment of an improved fabric rewind system 70, as aforementioned for the first and second embodiments 50 and 65, in order to squeeze out the entrapped air between successive spiral-like layers of fabric being rewound.

The vertical mode shown for the third embodiment 70 is shown with slitter means 76 and 84 suitably mounted near rewind rolls 78 and 86, respectively. The slitter means 76 makes the first cut or slit as the revolving rewind roll 78 peels off the fabric from the supply roll 72 and the slit or cut-off portion is rewound around core means 80 to form rewind roll 78. The slitter means 76 and 84 may be rotary or blade type slitters. Rotary type slitters are shown in the drawings.

As the supply roll 72 continues to turn the second slitter means 84 cuts or slits the next portion that is rewound around core means 88 to form rewind roll 86.

As the supply roll 72 continues to turn the remaining portion of the fabric is rewound around core means 94 to form rewind roll 92.

It is to be understood that the spaced slitter means 76 and 84 may both be located along the same common vertical centerline instead spaced from each other as aforementioned. In this latter case, some slit portions would travel further before being rewound.

It is to be noted and understood that the third embodiment 70 can be operated to rewind a single rewind roll (without slitters) as shown for the first and second embodiments 50 and 65, respectively. It is also to be noted and understood that the first and second embodiments 50 and 65, respectively, can also be structured with slitter means and corresponding rewinding means as shown for the third embodiment 70. The slitter means 76 and 84 may be adjusted to cut through a single layer or a plurality of layers of fabric.

It is to be noted that in the present invention the rewinding rolls 60, 78, 86, and 92 are the powered rolls and these rolls peel the fabric off of the supply rolls 52 and 72 as the case may be.

However, as noted hereinbefore, the power may be applied to the supply rolls 52 or 72, which in turn, revolve the rewinding rolls 60 or 78, 86, and 92 respectively by the interface pressured contact therebetween.

It is to be noted and understood that the downward pressure structure means 67 and the inward pressure structural means 82, 90, and 96 may be preloaded by mechanical spring means, hydraulic means, air pressure means or by other similar means.

It is to be noted and understood that the mounting centers for the supply rolls 52 and 72 and the head and tail stock combinations 57, 98, 100, and 102 are all adjustable in order to accept and hold a plurality of lengths of rewind cores 56, 80, 88, and 94. Thus, the centers of a single head and tail stock combination 57, 98, 100, or 102 can be adjusted for a core length for a simple rewind requirement from a supply roll 52 or 72 respectively. Or, the centers can be adjusted as needed for the plurality of rewind rolls that will be required from supply rolls 52 and 72 that are to be slit and rewound.

It is to be noted and understood that it is within the scope and intent of this invention that the rewind cores 56, 80, 88, and 94 may be of a length equal to the width of the fabric being rewound or they may be longer.

As can be readily understood from the foregoing description of the invention, the present structure can be configured in different modes to provide the ability to squeeze out entrapped air between succeeding spiral-like layers of fabric on a rewound roll and to accomplish the rewinding without a plurality of rolls and roll-type means as used in the prior art.

Accordingly, modifications and variations to which the invention is susceptible, may be practiced without departing from the scope and intent of the appended claims.

What is claimed is:

1. In a fabric rewind device, having a fabric rewind means, and a fabric slitting capability, and an improved fabric rewind system, comprising:

a structural frame means, said structural frame means consisting of a first support component, a second support component, and a base means, said first support component having a support member and a pivoted cantilever member, said first and second support components being suitably affixed to said base means;

a quantity of fabric, said quantity of fabric serving as a fabric supply, said fabric supply having width and length, said fabric supply having a first end and a second end, said first and second ends being across said width, said length being considerably longer than said width;

a first core means, said first end of said fabric supply being suitably and removably affixed to said first core means, said length of said fabric supply being rolled upon said first core means in succeeding spiral-like layers to form a supply roll, said supply roll being suitably and removably supported by said pivoted cantilever member of said first support component of said structural frame means, said supply roll being located at the distal end of the longer arm of said pivoted cantilever member said pivoted cantilever member being in a substantially horizontal mode in relation to the vertical alignment of said support member;

a first second core means, said first second core means being positioned in said second support component directly under, longitudinally parallel with, and vertically in line with said supply roll, said second end of said fabric supply being suitably and removably affixed to said first second core means, said length of said fabric supply being rewound upon said first second core means in succeeding spiral-like layers to form a rewind roll of said fabric, said fabric peeling from said supply roll as said fabric is rewound upon said first second core means, the direction of turning of said first second core means during the rewinding being counter to direction of turning of said supply roll as fabric is peeled therefrom, said rewinding being performed without any use of any intermediate rolls or idler means, said supply roll on said pivoted cantilever member resting upon and riding on said rewind roll and turning freely therewith from a position directly above said rewind roll as fabric is peeled from said supply roll and rewound upon said first second core means.

2. A fabric rewind system as recited in claim 1, wherein said supply roll of said fabric, resting upon, riding on, and turning freely with said rewind roll, from a position directly above said rewind roll, squeezes entrapped air from between each succeeding spiral-like layer of fabric being wrapped upon said first second core means, without the aid of any additional external force so as to form a tight and compact rewind roll of fabric.

3. A fabric rewind system as recited in claim 2, wherein said supply roll and said rewind roll are set and operated in a horizontal mode, said supply roll and said rewind roll each being horizontal in said structural frame means and in interface relation to each other.

4. A fabric rewind system as recited in claim 3 and additionally, a plurality of additional second core means, said plurality of additional second core means being spaced from said first second core means, said plurality of additional second core means being applied and operated in a manner similar to said first second core means.

5. A fabric rewind system as recited in claim 4 and additionally, a plurality of slitter means, each slitter means of said plurality of slitter means being associated with and operating with one of said additional second core means of said plurality of additional second core means, said slitter means slitting said fabric at said supply roll and being spaced from each other, each portion of said fabric formed by said slitting action thereafter being wound upon one of said plurality of additional second core means with which each said slitter means is associated and operating, and the remaining portion of said fabric after said slitting being rewound around said first second core means, all said fabric of said supply roll thereby being rewound after said slitting upon all of said second core means forming rewind rolls.

6. A fabric rewind system as recited in claim 3 and additionally, a downwardly acting structural pressure means, said downwardly acting structural pressure means applying and maintaining a constant downward pressure upon said supply roll through said first support component supporting said supply roll.

7. A fabric rewind system as recited in claim 6 and additionally, a plurality of additional second core means, said plurality of additional second core means being spaced from said first second core means, said plurality of additional second core means being applied and operated in a manner similar to said first second core means.

8. A fabric rewind system as recited in claim 7 and additionally, a plurality of slitter means, each slitter means of said plurality of slitter means being associated with and operating with one of said additional second core means of said plurality of additional second core means, said slitter means slitting said fabric at said supply roll and being spaced from each other, each portion of said fabric formed by said slitting action thereafter being wound upon one of said plurality of additional second core means with which each said slitter means is associated and operating, and the remaining portion of said fabric after slitting being rewound around said first second core means, all said fabric of said supply roll thereby being rewound after said slitting upon all of said second core means forming rewind rolls.

* * * * *